United States Patent [19]

Wedman

[11] 4,357,858

[45] Nov. 9, 1982

[54] FLUID ACTUATED CYLINDER ASSEMBLY

[75] Inventor: Thomas W. Wedman, Harper, Kans.

[73] Assignee: Green Line, Inc., Harper, Kans.

[21] Appl. No.: 121,789

[22] Filed: Feb. 15, 1980

[51] Int. Cl.[3] ..... F01B 29/00; F01B 31/00

[52] U.S. Cl. ..... 92/128; 92/164; 285/305

[58] Field of Search ..... 285/305; 92/164, 128

[56] References Cited

U.S. PATENT DOCUMENTS

| | | | |
|---|---|---|---|
| 1,464,386 | 8/1923 | Ingram | 285/305 |
| 2,645,513 | 7/1953 | Sterrett | 285/305 |
| 2,915,046 | 12/1959 | Larsen et al. . | |
| 3,113,490 | 12/1963 | Weaver . | |
| 3,136,230 | 6/1964 | Buckley . | |
| 3,162,098 | 12/1964 | Lindberg | 92/164 |
| 3,185,043 | 5/1965 | Dunham | 92/164 |
| 3,474,710 | 10/1969 | Stryker . | |
| 3,721,162 | 3/1973 | Kulhavy . | |
| 3,722,374 | 3/1973 | Densmore . | |
| 3,730,058 | 5/1973 | Siegel et al. . | |
| 3,853,083 | 12/1974 | Roland . | |
| 4,167,134 | 9/1979 | Yuda . | |

*Primary Examiner*—Paul E. Maslousky

*Attorney, Agent, or Firm*—Oblon, Fisher, Spivak, McClelland & Maier

[57] ABSTRACT

A fluid actuated cylinder assembly adapted to be connected to a pressurized fluid system which includes a cylinder barrel closed at one end thereof and open at the opposite end, the cylinder barrel having an annular groove formed in the interior circumferential surface thereof and a slot formed adjacent the opposite end, a cylinder head removably mounted in the opposite end of the cylinder barrel, the cylinder head having an annular groove formed in the exterior circumferential surface thereof in alignment with the annular groove formed in the cylinder barrel and an axially extending opening formed therein, a cylinder rod slidably mounted in the axially extending opening formed in the cylinder head, a piston connected with the cylinder rod within the cylinder barrel to form a first and second chamber, a ring member positioned in the annular grooves formed in the cylinder barrel and cylinder head slidable through the slot formed in the cylinder barrel and port means formed exclusively in the cylinder head for communicating the pressurized fluid system with at least one of the first and second chambers.

1 Claim, 3 Drawing Figures

FLUID ACTUATED CYLINDER ASSEMBLY

BACKGROUND OF THE INVENTION

1. Field of the Invention

This invention relates to a fluid actuated piston-type cylinder assembly.

More particularly, this invention relates to a compact fluid actuated cylinder assembly having a cylinder barrel fitted with an axially reciprocable piston including means for controlling operation of the piston.

This invention is also directed to a structure which allows for a fluid actuator cylinder assembly which is simple to assemble or disassemble and which results in a compact and economical cylinder assembly.

2. Description of the Prior Art

The heads of work cylinders have in the past been assembled by many well-known means. To some extent the form of this means depends upon the cylinder size and pressures to which it will be subjected. The invention herein will be described as used for both large and small sized cylinders for operation at various pressures. Cylinder heads in the past have, for example, been made with tie rod connections extending the entire length of the cylinder body which connect the heads to one another so that the tie-rods are under tension. The cylinder ends are secured by bolts, screws, flanges etc. such that all of these require manipulation and special tools for assembly and disassembly. All of these are, as a general rule, larger than the cylinder body diameter. Examples of other prior art are U.S. Pat. Nos. 3,474,710 and 4,167,134.

Another problem which besets manufacturers of hydraulic cylinders are that those which use heads screwed in place experience problems in alignment of the fluid ports in the heads with the cylindrical body so as to make the connection into fluid lines not a simple matter, as, for example, with both connections on the same side of the work cylinder.

SUMMARY OF THE INVENTION

An object of the present invention is to provide a fluid actuated cylinder adapted to be connected to a pressurized fluid system wherein the cylinder head is simple in construction, is easily mounted within an open end portion of a cylinder barrel and which is safely and inexpensively secured in position by utilizing a keeper ring.

A further object of this invention is to provide a fluid actuated cylinder assembly which is compact in size, may be assembled or disassembled without the use of special or expensive tools and which provides a cylinder that is highly efficient, occupies a very small space and which is extremely reliable.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENT

Figures 1, 2, 3:
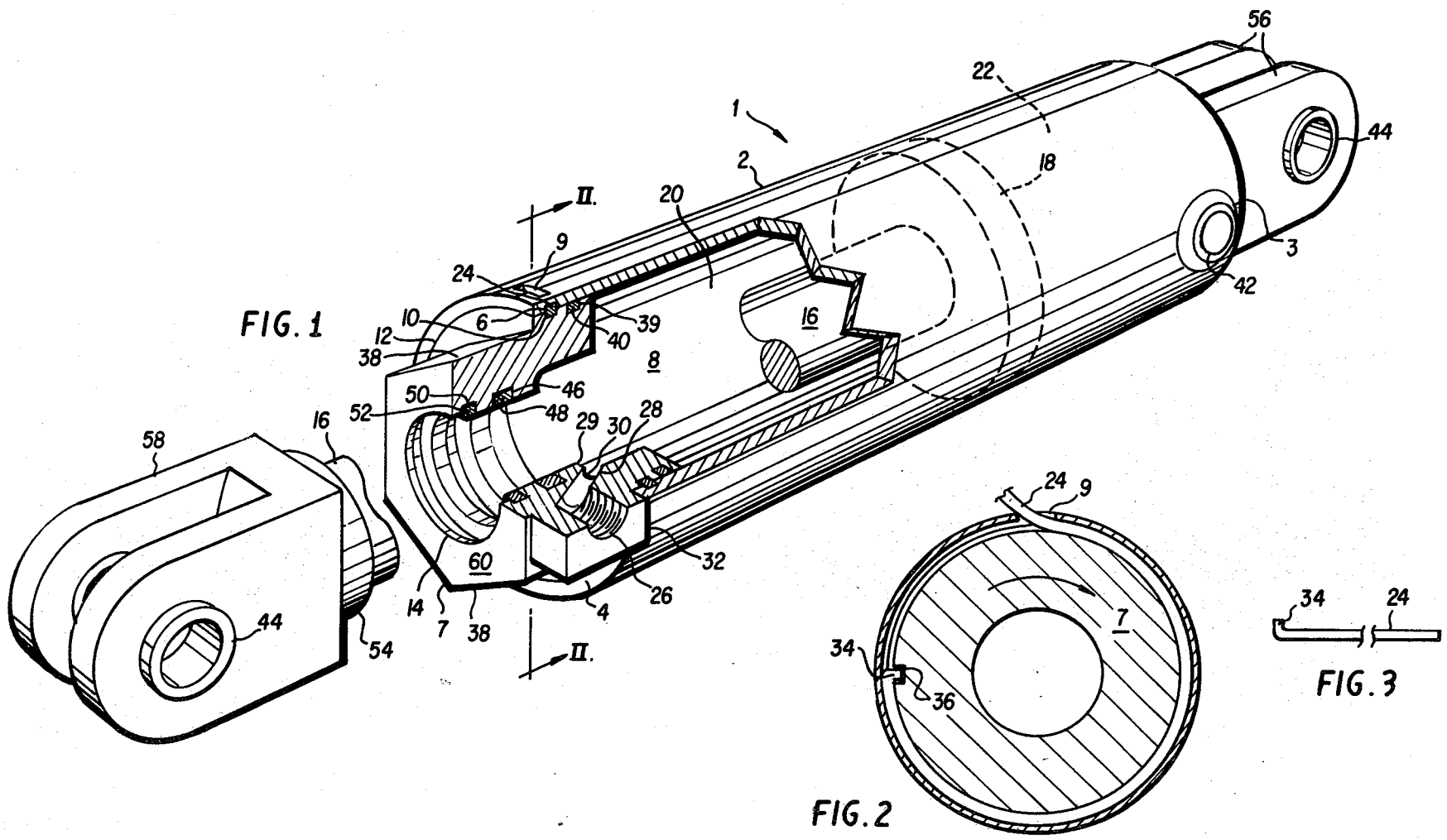
FIG. 1 is a partially cut away view of the fluid actuator cylinder assembly of the present invention.
FIG. 2 is a cross-sectional view of the fluid actuated cylinder of FIG. 1 taken along line II—II.
FIG. 3 is a side view of the keeper ring utilized in the fluid actuated cylinder assembly of FIG. 1.

Referring now to FIG. 1, reference numeral 1 indicates the fluid actuated cylinder assembly of the present invention which includes a cylinder barrel 2 having an end wall 3 which may be secured to the cylinder barrel 2 in a conventional manner such as, for example, welding, and includes an open end face 4 at the opposite end of the cylinder barrel 2.

An annular keeper ring groove 6 is formed in the interior circumferential surface 8 of the cylinder barrel 2. The cylinder barrel 2 also includes a slot 9 formed adjacent the end face 4. A removable cylinder head 7 is mounted in the end portion of the cylinder barrel 2 having end face 4 and includes an annular groove 10 formed in the exterior circumferential surface 12 of the cylinder head 7 in alignment with the annular groove 6 formed in the cylinder barrel 2. Cylinder head 7 also includes an axially extending opening 14 formed therein.

A cylinder rod 16 is slidably mounted in the axially extending opening 14 formed in the cylinder head 7. A piston 18 is connected with one end of cylinder rod 16 which is positioned within the cylinder barrel 2 so as to form first and second chambers 20, 22 within the cylinder barrel.

A ring member 24 is positioned in the aligned annular grooves 6, 10 formed in the cylinder barrel 2 and the cylinder head 7. The ring member 24 is slidable through slot 9 formed in the cylinder barrel 2 and serves to secure the cylinder head in its inserted position as shown in FIG. 1.

A first radially extending port 26 is formed exclusively in the cylinder head 7 for communicating a conventional pressurized fluid system (not shown) with at least one of the first and second chambers 20, 22. A second port means 42 is located at the opposite end of the cylinder barrel for communication with the pressurized fluid system for operation of piston 18.

First port means includes first port or channel 26 and includes a channel passage 28 which is formed within the cylinder head 7 at an inclination to the longitudinal axis of cylinder barrel 2 and which communicates with an opening 30 formed in an interior wall 29 of the cylinder head 7.

Cylinder head 7 includes a radial projection 32 extending from the cylinder head 7 outside of the cylinder barrel 2 such that first port means 26 is partially formed in projection member 32.

Ring member 24 includes a unitary hook portion 34 formed at one end thereof, as best shown in FIGS. 2 and 3. Cylinder head 7 includes a second groove 36 formed therein for cooperably engaging foot or hook portion 34 of the ring member upon rotation of cylinder head 7 in the direction of the arrow as illustrated in FIG. 2.

As best shown in FIG. 1, the portion of the cylinder head 7 extending outside of the cylinder barrel 2 is the portion which includes the first port 26 while passage 28 serves to communicate the first port 26 with the first chamber 20 such that no port, opening or aperture is necessary in the end portion 4 cylinder barrel 2 adjacent cylinder head 7. The net result is that the cylinder barrel 2 can be produced so as to be compact and simple in construction without any corresponding problems of alignment with a port in the cylinder head itself with a corresponding aperture in the cylinder head for effective communication with the pressurized fluid system. Moreover, this results in a highly compact fluid actuated cylinder assembly which occupies a very small space and is extremely reliable.

The cylinder head 7 includes a plurality of radially inwardly stepped flat exterior portions 38 forming a regular polygonal projection for cooperation with an associated tool (not shown) for rotation of the cylinder head 7 so as to position the ring member 24 in annular grooves 6, 10 formed in the cylinder barrel 2 and cylinder head 7, respectively.

An O-ring groove 39 is formed in cylinder head 7 such that an O-ring 40 can be positioned within groove 39 for providing an effective seal and to prevent escape of fluid from first chamber 20.

The fluid actuated cylinder assembly 1 may also include cylinder ears 56 extending from end wall 3 which include hardened tension bushings 44 for attachment to corresponding conventional structure to which the fluid actuated cylinder assembly 1 is attached.

A seal ring groove 46 is also provided in the cylinder head 7 for housing a seal ring 48 while a wiper ring groove 50 may also house a wiper ring 52 for supplementing effective sealing of fluid within first chamber 20 of cylinder barrel 2.

The fluid actuated cylinder assembly 1 may further include a collar member 54 positioned adjacent clevis 58 which in turn may include hardened tension bushings 44. Collar 54 serves to allow for adjustment of retracted operation of piston 18 within cylinder barrel 2 and which can be actuated so as to abut with flat end portion 60 of cylinder head 7.

Assembly of the fluid actuated cylinder assembly 1 includes the steps of positioning O-ring 40 within O-ring groove 39 and sliding cylinder head 7 through end face 4 of cylinder barrel 2 such that annular keeper ring groove 10 formed in cylinder head 7 is in alignment with annular keeper ring groove 6 and keeper ring slot 9. Moreover, second groove 36 formed in cylinder head 7 is aligned with slot 9 for insertion of hook portion 34 of the keeper ring so as to cooperatively engage with second groove 36. Naturally, prior to insertion of cylinder head 7, cylinder rod 16 attached to piston 18 has been positioned within cylinder barrel 2 with cylinder rod 16 being open ended at the left end portion thereof in FIG. 1 for subsequent attachment of clevis 58, hardened tension bushings 44 and collar 54. An associated tool is then fitted over the flat exterior surface portions 38 of the cylinder head and is rotated in the clockwise direction as designated by the arrow in FIG. 2 so as to feed the keeper ring 24 through slot 9. It is to be understood that removal of keeper ring 24 is effected by rotating cylinder head 7 in a counterclockwise direction such that the keeper ring is fed through keeper ring slot 9.

Upon complete insertion of keeper ring 24, collar 54, and clevis 58 with hardened tension bushings 44 may be secured to the left end portion of cylinder rod 16. It can thus be appreciated that the cylinder head 7 is easily insertable within a portion of cylinder barrel 2 and that a substantial portion of the cylinder head remains positioned outside the flat exterior wall portion 38 thereof, including first port 26 which communicates with the pressurized fluid system.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A fluid actuated cylinder assembly adapted to be connected to a pressurized fluid system comprising:

a cylinder barrel closed at one end thereof and open at the opposite end, said cylinder barrel having an annular groove formed in the interior circumferential surface thereof and a slot formed adjacent said opposite end;

a cylinder head removably mounted in said opposite end of said cylinder barrel, said cylinder head having an annular groove formed in the exterior circumferential surface thereof in alignment with said annular groove formed in said cylinder barrel and an axially extending opening formed therein;

a cylinder rod slidably mounted in said axially extending opening formed in said cylinder head;

a piston connected with said cylinder rod within said cylinder barrel to form a first chamber and a second chamber;

a ring member positioned in said annular grooves formed in said cylinder barrel and said cylinder head slidable through said slot formed in said cylinder barrel;

first port means formed in said cylinder head for communicating said pressurized fluid system with said first chamber;

said first port means comprising a channel extending from an exterior portion of said cylinder head to an interior wall portion of said cylinder head;

said channel comprising an opening formed in said interior wall portion of said cylinder head, a radially extending port formed in said cylinder head, and a passage formed at an inclination to the longitudinal axis of said cylinder barrel;

said cylinder head further comprising a projection member extending radially from said cylinder head outside the circumference of said cylinder barrel wherein said first port means is partially formed in said projection member;

said ring member including a hook portion unitarily formed at one end thereof and wherein said cylinder head includes a second groove formed therein for cooperatively engaging said hook portion of said ring member;

said cylinder head including a plurality of flat exterior surface portions forming a regular polygonal projection for cooperation with an associated tool for rotation of said cylinder head so as to position said ring member in said annular grooves formed in said cylinder barrel and said cylinder head and wherein said cylinder head further comprises a single removable cylinder head; and second port means formed in said cylinder barrel for communicating said pressurized fluid with said second chamber.

* * * * *